United States Patent [19]

Soga

[11] Patent Number: 4,934,930

[45] Date of Patent: Jun. 19, 1990

[54] HEAT ROLLER FIXING DEVICE AND IMAGE FIXING METHOD

[75] Inventor: Setsuo Soga, Tokyo, Japan

[73] Assignee: Ricoh Company, Ltd., Tokyo, Japan

[21] Appl. No.: 289,381

[22] Filed: Dec. 23, 1988

Related U.S. Application Data

[63] Continuation-in-part of Ser. No. 112,089, Oct. 26, 1987, Pat. No. 4,813,868.

[30] Foreign Application Priority Data

Oct. 24, 1986 [JP] Japan ..... 61-253343

[51] Int. Cl.[5] ..... F27B 9/28; G03G 15/20

[52] U.S. Cl. ..... 432/60; 432/226; 219/216; 355/284; 355/290

[58] Field of Search ..... 432/8–60, 432/228; 219/216, 469; 355/3 FU

[56] References Cited

U.S. PATENT DOCUMENTS

| | | | |
|---|---|---|---|
| 4,038,026 | 7/1977 | Wada et al. | 432/60 |
| 4,101,267 | 7/1978 | Mueller | 432/60 |
| 4,119,831 | 10/1978 | Sato | 219/216 |
| 4,487,158 | 12/1984 | Kaysor | 432/60 |
| 4,639,405 | 1/1987 | Franke | 219/216 |
| 4,653,897 | 3/1987 | Fromam | 432/60 |
| 4,727,394 | 2/1988 | Bov, Jr. et al. | 432/60 |
| 4,745,431 | 5/1988 | Kogure et al. | 355/3 FU |
| 4,814,819 | 3/1989 | Torino et al. | 432/60 |

*Primary Examiner*—Henry C. Yuen

*Attorney, Agent, or Firm*—Oblon, Spivak, McClelland, Maier & Neustadt

[57] ABSTRACT

A heating roller having a surface layer of Teflon ® and a pressing roller having a surface layer of an elastomeric material are held rotatably against each other for fixing a full-color toner image to a toner carrier therebetween. The ratio (1/V) between the nip width 1 of the heating and pressing rollers and the peripheral speed V of the rollers is selected to be at least 0.06, and the pressure of contact per unit area between the heating and pressing rollers at their nip region is selected to be at least 7 kg/cm$^2$, for increasing a temperature range corresponding to the rubber range of toners used. The toners which have a small molecular weight and a small molecular weight distribution are prevented from being offset before the toners are fixed. Teflon ® with desirable features can therefore be used as the surface layer of the heating roller.

5 Claims, 3 Drawing Sheets

HEAT ROLLER FIXING DEVICE AND IMAGE FIXING METHOD

This application is a continuation-in-part of application Ser. No. 07/112,089, filed Oct. 26, 1987, U.S. Pat. No. 4,813,868.

BACKGROUND OF THE INVENTION

1. Field of the Invention

The present invention relates to a heat roller fixing device for use in a full-color image generating apparatus. It also relates to an image fixing method, and more particularly to an image fixing method for a full-color electrophotographic copying machine including a heating roller.

2. Discussion of the Background

There is known a device for fixing toner images produced by superposing three or four color toners on a toner carrier (hereinafter referred to as a "copy paper") in a full-color copying machine or the like, the device including a nip region having a heating roller and a pressing roller for heating and pressing the copy paper to fix the toner images. Generally, full-color copies which are glossier than monochromatic copies are preferred, and full-color copies are desired which carry images of high light transmittance (color reproducibility) so that they can be used as film images for use with an overhead projector (hereinafter referred to as an "OHP film image"). For these reasons, toners for use on full-color copies have low molecular weights, and narrow molecular weight distributions or, stated otherwise, low toner cohesion.

If a heating roller having an offset prevention layer of Teflon® were employed for fixing a full-color copy image which uses toners of low molecular weights and low toner cohesion, hot offsetting and fixing failure would simultaneously be brought about. Heretofore, any fixing device including a heating roller having a surface layer of Teflon® has not been available for fixing full-color copy images. Conventional fixing devices in full-color copying machines or the like have employed heating rollers made of silicone rubber having good release capability.

Fixing of toner to a toner sheet is regarded as adhesion of the toner to the toner sheet (see, for example, a paper entitled "Fixing ability of electrophotographic toner" at the 51st research meeting of the Electrophotographic Society.)

The paper referred to above indicates that adhesion includes the elemental processes of liquefaction, flowing, wetting, and solidification, and that in order to fix toner, the viscoelasticity of toner is required to be within a certain range due to heat fusion.

In addition, the hot offset of toner (which means toner transfer when the toner is heated) is generated by cohesion destruction which occurs when the adhesive force between the toner and the heating roller is stronger than the cohesive force of the toner.

Therefore, the toner viscoelasticity and adhesion are important parameters for fixing toner.

The toner viscoelasticity is affected by the molecular weight and molecular weight distribution of toner.

FIG. 3 of the accompanying drawings shows the relationship between the molecular weight of toner and a temperature range in which the toner is fixable, the temperature range being a factor in toner fixing characteristics.

The hatched range shown in FIG. 3 which is surrounded by fixing starting temperatures and offset starting temperatures indicates a good toner fixing range.

The good toner fixing range is a stage prior to a flowing range in which the toner cohesion is destroyed, and is generally referred to as a rubber range. As is apparent from FIG. 3, if the width (temperature width) of the rubber range is narrow, the toner cohesive force tends to be small as is the case with a small toner molecular weight. If the width of the rubber range is narrow, therefore, the offset is liable to happen and a fixture failure is apt to occur.

It is known that the heating roller may be made of Teflon® which meets desired heat resistance and durability against a plurality of colored toners used in full-color copying.

However, even if Teflon® is used, the offset is likely to take place when toner is fixed in a narrow rubber range, and hence the desired features of Teflon® cannot be utilized in such a narrow rubber range.

In order to avoid the above problem, a heating roller in a fixing device in a full-color copying machine is made of silicone rubber. Silicone rubber is believed to be better in toner peelability than Teflon®.

However, a toner fixing method using a heating roller of silicone rubber has the following disadvantages.

(1) Since silicone rubber is less durable against solvents and chemicals than Teflon®, a fixing roller is contaminated by a pigment or dye of colored toner. As a result, the fixing roller has poor toner peelability and becomes short in service life. This phenomenon does not happen when only black toner is used.

(2) Because silicone rubber is lower in mechanical strength than Teflon®, the types of copy sheets that can be used are much more limited than would be available in a monochromatic copying process, and hence a range of usable copy sheets is limited.

(3) An adhesive layer between the core of the heating roller and a silicone rubber layer around the core is susceptible to high temperatures, temperature control must be effected to give a desired level of peeling resistance to the adhesive layer on its surface held against the core. The roller surface cannot easily reach the temperature at which toner can be fixed because of the difference between heat transfer characteristics of the core and the silicone rubber layer. To solve this problem, it is proposed to position another heating roller held against the surface of the existing heating roller for keeping the surface of the silicone rubber roller at the toner fixing temperature. With this proposed arrangement, however, since the area where the heating rollers contact each other is small, heat transfer cannot well be effected therebetween, and as a consequence high-speed toner fixing cannot be performed.

(4) A greater amount of toner coheres in a full-color copying process than a monochromatic copying process. Therefore, since the thickness of the toner layer is large, surface irregularities are developed on the copy sheet even if it is heated and pressed.

In the conventional fixing devices, pressing rollers have a surface layer of silicon rubber having a thickness ranging from 2.5 to 3.0 mm. Therefore, when successive copy papers are fed into the fixing device, the temperature of the pressing roller largely drops. To avoid this, it has been necessary to give a higher temperature setting to make up for such a large temperature drop.

However, such a higher temperature setting contaminates the heating roller, lowers its release capability, and shortens its service life. The temperature of the core of the pressing roller has to be controlled in view of the heat resistance of the silicone rubber layer. Since toner images are usually fixed by three rollers, their thermal responses are low, making it difficult to effect high-speed image fixing operation. Inasmuch the pressure of contact between the heating and pressing rollers per nip area has been in the range of from 2 to 3 kg/cm$^2$, the toner layer has been thick, resulting in fixed images having surface irregularities, just like oil paintings, peculiar to full-color copies.

SUMMARY OF THE INVENTION

It is therefore an object of the present invention to provide a heat roller fixing device which will solve the problems of the conventional devices, and has a heating roller of increased durability and service life and can produce smooth images without surface irregularities.

To achieve the above object, the present invention provides a fixing device which is characterized by a heating roller which has a surface layer made of silicone rubber and having a thickness of 0.4 mm at most, and by a pressing roller which has a surface layer made of an elastic material. Each of the rollers has a nip width, L, and a peripheral speed, V, with the ratio L/V being at least 0.07 sec. The pressure of contact between the rollers per nip area is at least 6 kg/cm$^2$.

With the above arrangement, the range of temperatures for fixing toners can be increased, and a temperature setting can be lowered. Consequently contamination of the heating roller is reduced, and the durability and service life of the heating roller are both increased. Since the pressure of contact between the rollers per nip area is increased, the fixed images produced do not have surface irregularities, and are smooth and of high quality.

It is another object of the present invention to provide an image fixing method which uses a heating roller for heating a fixing roller, the heating roller having a layer of Teflon® that has heretofore been used.

Another object of the present invention is to provide an image fixing method which can meet requirements of a full-color copying process with a simple arrangement.

To achieve the above objects, according to the present invention, a heating roller and a pressing roller are held in pressed contact with each other, the ratio (1/V) between the nip width 1 of the heating and pressing rollers and the peripheral speed V of the rollers is selected to be at least 0.06, and the pressure of contact per unit between the heating and pressing rollers at their nip region is selected to be at least 7 kg/cm$^2$, for fixing a multicolor toner image to a toner carrier.

With the present invention, toners on the toner carrier are given a good toner fixing range which does not exceed 40° C. from a toner fixing starting temperature for the toners.

Moreover, since a wide good toner fixing range is available, full-color copying toners having small molecular weights, molecular weight distributions, and relatively small toner cohesive forces are prevented from adhering to Teflon®, and hence a heating roller can have a Teflon® layer.

Furthermore, an image produced by the full-color copying process is glossy and light-transmissive.

BRIEF DESCRIPTION OF THE FIGURES

The above and other objects, features and advantages of the present invention will become more apparent from the following description when taken in conjunction with the accompanying figures in which preferred embodiments of the present invention are shown by way of illustrative example.

DESCRIPTION OF THE PREFERRED EMBODIMENTS

Figure 1:
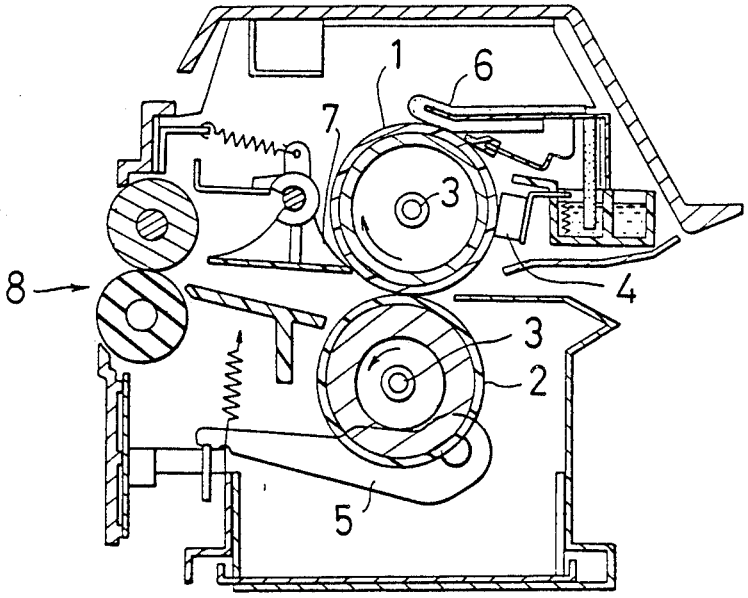
FIG. 1 is a cross-sectional view of an image fixing device used for carrying out an image fixing method of the present invention.
Figure 2:
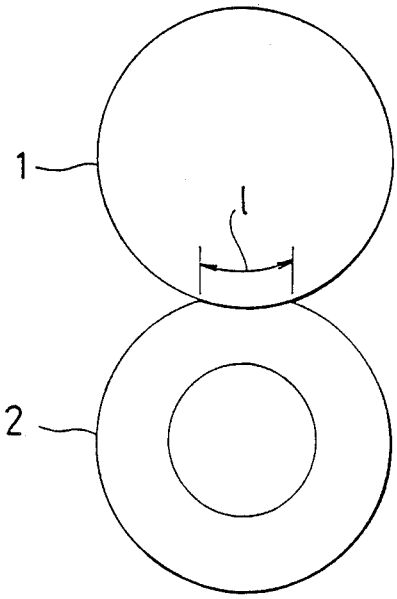
FIG. 2 is a schematic view explaining the nip region of rollers in the image fixing device.

An image fixing method according to the present invention can be effected, for example, by an image fixing device as shown in FIG. 1.

The image fixing device includes a heating roller 1 having a surface layer of Teflon® and a pressing roller 2 having a surface layer of an elastomeric material such as silicone rubber.

Each of the heating and pressing rollers 1, 2 has a heater 3 housed therein. However, the pressing roller 2 may not have its own heater (as described later on). A temperature sensor 4 such as thermistor is held against the surface of the heating roller 1 for detecting the surface temperature thereof.

A detected signal from the thermistor 4 is applied to a fixing temperature control unit (not shown), which is responsive to the signal from the thermistor 4 for controlling the heaters 3 so that the surface temperature of the heating roller 1 will not exceed an offset starting temperature above a fixing starting temperature for toner to be fixed.

Figure 3:
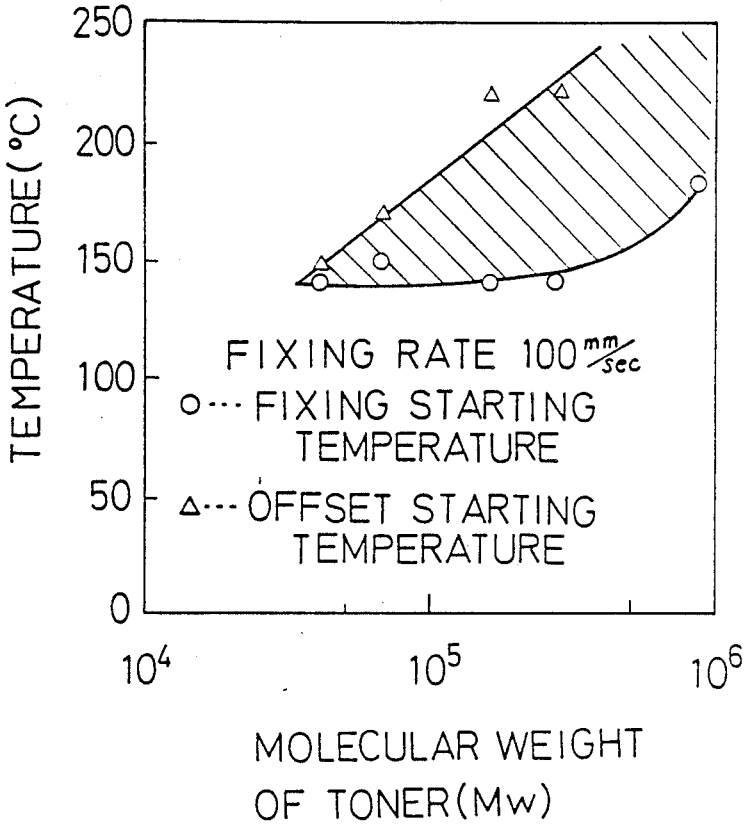
FIG. 3 is a graph showing the relationship between temperatures at which toner can be fixed and toner molecular weights.

The surface temperature of the heating roller 1 controlled by the thermistor 4 is determined to be in a temperature range corresponding to the rubber range of toner. More specifically, the surface temperature of the heating roller 1 is not in excess of 40° C. above the toner fixing starting temperature shown in FIG. 3.

The heating roller 1 and the pressing roller 2 are pressed against each other by means of a pressing cam 5, and are driven to rotate in their respective directions of the arrows by a driving means (not shown). The pressing cam 5 presses the heating roller 1 and the pressing roller 2 against each other so that the pressure of contact C per nip area will be 7 kg/cm$^2$ or higher.

The contact pressure C is expressed by:

$$C = P/al \ (kg/cm^2) \quad (1)$$

where l is the nip width (cm) of the rollers 1, 2, a is the axial length (cm) of the contacting area between the rollers 1, 2, and P is the total pressure (kg) applied to the rollers 1, 2.

The driving means drives the rollers 1, 2, to rotate about their own axes such that the rate (1/V) between the width 1 (cm) of the rollers 1, 2 and the peripheral speed V (cm/sec.) of the rollers 1, 2 will meet:

$$1/V \geqq 0.06 \text{ (sec.)} \quad (2)$$

The image fixing device also has an oil applicator 6 for applying silicone oil to the circumferential surface of the heating roller 1, a peeling member 7 for peeling a copy sheet (not shown) to which an image has been fixed from the heating roller 1, and sheet discharge rollers 8 for discharging a fixed copy sheet from the image fixing device.

Figure 4:
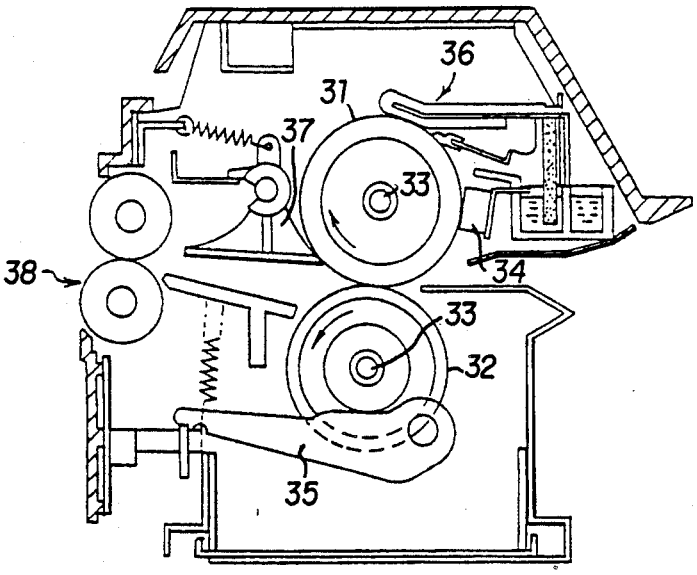
FIG. 4 is a front elevational view of a fixing device according to an embodiment of the present invention.
Figure 5:
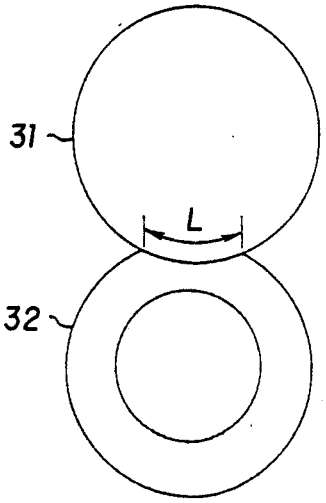
FIG. 5 is an enlarged front elevational view of a portion of the fixing device, wherein 31 is a heating roller, 32 is a pressing roller, 33 is a heater, 34 is a thermistor, and 35 is a pressing cam.

Another embodiment of the present invention will now be described with reference to the FIGS. 4 and 5 which show a heating roller 31 and a pressing roller 32. The heating roller 31 has a surface layer made of RTB silicone rubber and having a thickness of 0.4 mm or less.

The thickness of the silicone rubber layer is selected to be 0.4 mm or less in order to improve the thermal response of the heating roller 31, make the heating roller 31 resistant to swelling in contact with silicone oil, and render image surface irregularities, which would otherwise be produced by a thick silicone rubber layer, smooth in combination with the pressure of contact, referred to infra.

The pressing roller 32 has a surface layer made of an elastic material such as silicone rubber or the like. The heating roller 31 and the pressing roller 32 have heaters 33 disposed therein. However, the heater in the pressing roller 32 may be dispensed with.

A thermistor 34 is held against the surface of the heating roller 31 for detecting the temperature of the surface of the heating roller 31. A detected signal from the thermistor 4 is sent to a fixing temperature controller (not shown), which controls the temperature of the surface of the heating roller 31 in response to the signal from the thermistor 34.

The heating roller 31 and the pressing roller 32 are pressed against each other by means of a pressing cam 35, and are rotated about their own axes in the directions of the arrows, respectively, by a drive means (not shown). The pressing cam 35 presses the rollers 31, 32 against each other such that the pressure C of contact between the heating roller 31 and the pressing roller 31 per nip area will be 36 kg/cm$^2$ or higher. The contact pressure C is expressed by the relation:

$$C = P/aL \text{ (kg/cm}^2\text{)} \quad (3)$$

where L is the nip width (cm) of the rollers 31, 32, a is the length (cm) (axial length) of the contacting portions of the rollers 31, 32, and P is the total pressure (kg) applied to the rollers 31, 32.

The drive means rotates the rollers 31, 32 such that the ratio of the nip width L (cm) of the rollers 31, 32 to the peripheral speed V (cm/sec.) of the rollers 31, 32 meets the following relation:

$$L/V \geqq 0.07 \text{ (sec.)} \quad (4)$$

Denoted at 36 is an oil coating means for coating silicone oil on the surface of the heating roller 31, a peeling means 37 for peeling a copy paper (not shown) with a fixed image from the heating roller 31, and a pair of paper discharge rollers 38.

Having generally described this invention, a further understanding can be obtained by reference to certain specific examples which are provided herein for purposes of illustration only and are not intended to be limiting unless otherwise specified.

The following experiment was conducted using as image fixing device as constructed above.

The experiment was effected in order to know how the image fixing device of the invention is better than a conventional image fixing device as to the toner fixing temperature width or range (°C.), the glossiness (%) of a copied image, and the availability of transfer paper (which means the number of available types of transfer paper that can be used as a copy sheet; the greater the number of available types of transfer paper, the greater the availability of transfer paper).

The glossiness (%) was measured at an illumination angle of 60° according to JIS Z8741, using a glossmeter manufactured by Japan Denshoku Kogyo K.K.

The following sheets of transfer paper (copy sheets) were used:

(a) Type 6000 manufactured by K. K. Ricoh;
(b) OHP film manufactured by K. K. Ricoh;
(c) 50 g/cm$^2$–90 g/cm$^2$ paper manufactured by NBS Co.; and
(d) Groundwood paper.

Toners used were toners (molecular weight: $6 \times 10^4$) for use with a color copying machine "Ricoh Color 5000" manufactured by K. K. Ricoh. The toners had a softening temperature of 70° C. and a flow starting temperature (liquefaction temperature) of 88° C. as measured by a flow tester manufactured by Shimazu Seisakusho. The temperature range between the toner softening temperature and the flow starting temperature is generally known as the rubber range. The smaller the rubber range, the smaller the toner cohesive force. It has been believed that those toners which have a small rubber range and a small molecular weight cannot be fixed by a roller having a Teflon surface layer (see FIG. 3).

[EXPERIMENTAL EXAMPLE—1]

The heating roller 1 had a sprayed layer of Teflon, and the pressing roller 2 had an elastomeric layer having a thickness of 4 mm and a rubber hardness (JISA) of 60 degrees. The rollers 1, 2 were pressed against each other by pressing the pressing roller under 120 kg, and had a nip width 1 of 6.0 mm.

The contact pressure C was 11 kg/cm$^2$ as calculated from the equation (1).

When the rollers 1, 2 were rotated at a peripheral speed of 100 mm/sec., the ratio 1/V was 0.06 sec. as calculated from the equation (2).

Under the above fixing conditions, a full-color copy was produced by superposing three color toners. The lower fixing limit temperature (fixing starting temperature in FIG. 3) was 100° C., and the hot offset producing temperature (offset starting temperature in FIG. 3) was 130° C., so that the fixing temperature range in which good image fixing can be effected was 30° C. This was as effective as a substantial increase in the rubber range of the toners. A well fixed image having glossiness of 20% was produced. In this example, all sheets of transfer paper could be used. Many types of transfer paper that can be used were available, or the availability of transfer paper was high.

[EXPERIMENTAL EXAMPLE—2]

The same heating roller 1 and pressing roller 2 as in the experimental example 1 were used. The total pressure P and the peripheral speed V for the heating roller 1 and the pressing roller 2 were selected such that the contact pressure C was 10 kg/cm²and 1/V was 0.11 sec. Otherwise, the conditions were the same as those of the experimental example—1. As a result, the fixing temperature range was 40° C., and the glossiness was 30%. The availability of transfer paper was high, and all types of copy sheets ranging from 24 g/cm² to 90 g/cm² could well be used.

[EXPERIMENTAL EXAMPLE—3]

Under the same conditions as those of the experimental example—1 except for C=10 kg/cm² and 1/V=0.13 sec., the fixing temperature range was 40° C., and the glossiness was 35%. Good images were produced as in the experimental example—2.

[EXPERIMENTAL EXAMPLE —4]

Under the same conditions as those of the experimental example—1 except for C=7 kg/cm² and 1/V=0.13 sec., the fixing temperature range was 30° C., and the glossiness was 20%. Good images were produced as in the experimental example—1.

As can be seen from the result of the above experimental examples and their fixing conditions, toners of a small rubber range and a small molecular weight can be fixed by a heating roller having a surface layer of Teflon by giving special fixing conditions that could not be assumed from the fixing conditions in ordinary image fixing devices.

In order to check the limits of the above special fixing conditions, the following comparative experiment was carried out.

[COMPARATIVE EXAMPLE—1]

Under the same conditions as those of the experimental example—1 except for C=11 kg/cm² and 1/V=0.05 sec., the fixing temperature range was reduced to 20° C. and the glossiness was lowered to 15%. The availability of transfer paper was bad.

[COMPARATIVE EXAMPLE—2]

Under the same conditions as those of the comparative example—1 except for C=6 kg/cm² and 1/V=0.11 sec., the fixing temperature range was reduced to 20° C. and the glossiness was lowered to 15% as with the comparative example—1. The image fixing device were not practically feasible.

The results of the above comparative examples indicate that the image fixing device will be practically feasible if C≧7 kg/cm² and 1/V≧0.06 among the fixing conditions.

The following experiment was further conducted in order to show that the fixing conditions in each of the aforesaid experimental examples are well beyond the obviousness range that can be achieved by those skilled in the art.

[CONVENTIONAL EXAMPLE—1]

The same experimental conditions as those of the experimental example—1 except for 1/V=0.04 sec. and C=3 kg/cm², which are ordinary conditions in an image fixing device using a heating roller using a Teflon surface layer, were employed. As a result, the fixing temperature range was 0° C., the glossiness was unmeasurable, and it was impossible to fix toners to any types of transfer paper. Therefore, the fixing conditions employed in the fixing method of the present invention are quite beyond normal setting ranges.

The following experiment was also conducted under the same conditions as those of the conventional example 1 using an image fixing device having a heating roller with a surface layer of RTV (Room Temperature Vulcanization) silicone rubber coating, which is used as a fixing roller in a conventional full-color copying apparatus.

[CONVENTIONAL EXAMPLE—2]

Under the fixing conditions that 1/V=0.04 sec., and C=3 kg/cm² the fixing temperature range was 40° C. and the glossiness was 40%. The image fixing device was therefore well practically feasible. However, for reasons not known, the toners could not be fixed to all of the sheets of transfer paper that were used in the experiment.

The results of the above experiments are tabulated in the following table 1:

TABLE 1

| | 1/V (sec.) | C (kg/cm²) | Fixing temp. range (°C.) | Glossiness (%) | Paper availability |
|---|---|---|---|---|---|
| A-1 | 0.06 | 11 | 30 | 20 | Good |
| A-2 | 0.11 | 10 | 40 | 30 | Good |
| A-3 | 0.13 | 10 | 40 | 35 | Good |
| A-4 | 0.13 | 7 | 30 | 20 | Good |
| B-1 | 0.05 | 11 | 20 | 15 | Bad |
| B-2 | 0.11 | >6 | 20 | 15 | Bad |
| C-1 | >0.04 | >3 | 0 | — | Bad |
| C-2 | >0.04 | >3 | 40 | 40 | Bad |

A: Experimental example
B: Comparative example
C: Conventional example

The availability of transfer paper was judged "Good" if all of the types of transfer paper could be used, and judged "Bad" otherwise.

The thickness of the toner layer on a copy sheet produced in a full-color copying process is greater than the thickness of the toner layer on a copy sheet produced in a monochromatic copying process. In a full-color copying process, the toners cannot well be fixed unless the toner layer is heated quickly into the rubber range. In a conventional full-color copying fixing device, therefore, it has been necessary to provide heaters in the heating and pressing rollers for heating a copy sheet on its both surfaces to thereby increase heat transfer to the toner layer on the copy sheet.

Such a conventional fixing device however consumes a great amount of electric power such as 900 W, and hence cannot be used with a normal electric outlet (having a capacity of 100 V, 15A). To avoid this difficulty, it has been practice to lower the copying rate (the number of copies that can be produced per minute) of a conventional color copying machine below its copying capacity. This is a substantial reduction in the copying machine performance. Moreover, since the pressing roller is supported displaceably with respect to the heating roller, it is not preferable to provide a heater in the pressing roller.

As is well known in the art, it is possible to lower the heating temperature by increasing the contact pressure C between the heating roller and the pressing roller.

The same experiments as those described above were conducted using an image fixing device with the heater 3 removed from the pressing roller 2 shown in FIG. 1. The experimental results are given in the following table 2:

TABLE 2

| | 1/V | C | Fixing temp. range (°C.) | Evaluation |
|---|---|---|---|---|
| A-1 | 0.06 | 7 | 30 | Good |
| A-2 | 0.11 | 10 | 40 | Good |
| A-3 | 0.13 | 10 | 40 | Good |
| A-4 | 0.13 | 7 | 30 | Good |
| B-1 | 0.05 | 11 | 20 | Bad |
| B-2 | 0.11 | 6 | 20 | Bad |
| C-1 | 0.04 | 3 | 10 | Bad |
| C-2 | 0.04 | 3 | 30 | Good |

A: Experimental example
B: Comparative example
C: Conventional example

The evaluation "Good" indicates that the toners can be fixed, and the evaluation "Bad" indicates that the toners cannot be fixed. This evaluation is not related to the availability of transfer paper.

Table 2 shows that an image fixing device with a heater disposed only in the heating roller can well fix images or toners to copy sheets. A copying machine with such an image fixing device can reduce electric power consumption and increase the copying rate.

With the present invention, as described above, even if full-color copying toners having a small molecular weight and a small molecular weight distribution are employed, the temperature range corresponding to the good fixing temperature range can be increased. The toners can be fixed completely before they are offset. Therefore, the fixing roller can have a surface layer of Teflon® for utilizing the advantageous features of Teflon®.

Since the temperature range in which the toners can be fixed can easily be achieved by increasing the temperature range known as the rubber range, temperature control can be effected with ease.

Experimental example and comparative examples carried out with respect to the heat roller fixing device of the invention are described below.

EXPERIMENTAL EXAMPLE—5

In this example, the heating roller 31 was prepared by applying an adhesive to an aluminum core, spraying KE-1300RTV (manufactured by The Shin-Etsu Chemical Co., Ltd.) on the adhesive layer to a thickness of 300 μ, and drying the sprayed layer into a surface layer. The pressing roller 32 had a surface layer made of an elastic material having a rubber hardness degree of 60 (JISA) and a thickness of 4 mm. When the rollers 31, 32 were pressed under 60 kg on one side, the nip width L thereof was 7.0 mm.

As a result, the contact pressure C was 8 kg/cm$^2$ as calculated according to the equation (3). When the peripheral speed V of the rollers 31, 32 was 100 mm/sec., the ratio L/V was 0.07 sec. according to the equation (4).

A full-color copy was prepared with three color toners under the above fixing conditions. As a result, the lower-limit fixing temperature was 130° C., the hot offset producing temperature was 180° C., and the fixing temperature range for good image fixing was 50° C. The produced image was smooth and high in quality. A durability test was conducted with a temperature setting of 140° C. The results of the durability test indicated that any deterioration of the heating roller 31 after thirty thousand copies were produced was small, and the hot offset generating temperature was 175° C. and the fixing temperature range was 45° C.

EXPERIMENTAL EXAMPLE—6

The same heating roller 31 and pressing roller 32 as those used in the experimental example—5 were employed, and the same experiment as in the experimental example—5 was conducted in which the total pressure P and the peripheral speed V were preset such that the contact pressure C was 10 kg/cm$^2$ and the ratio L/V was 0.11 sec. As a result, the lower-limit fixing temperature was 120° C., and the fixing temperature range was 60° C. A durability test with a temperature setting of 130° C. indicated that the hot offset generating temperature was 175° C. after producing thirty thousand copies.

COMPARATIVE EXAMPLE—3

The same experiment as described above, experimental examples 5 and 6, was conducted under the fixing conditions: C=11 kg/cm$^2$ and L/V=0.05 sec. As a consequence, the lower-limit fixing temperature was 145° C., the hot offset generating temperature was 180° C., and the fixing temperature range was 35° C. A durability test with a temperature setting of 155° C. resulted in the generation of offsetting when thirty thousand copies were produced. However, image smoothness was good.

In each of the above examples, the toners (molecular weight: $6\times10^4$) for use with color copying machines "Ricoh Color 5000" manufactured by Ricoh Co., Ltd. were used. These toners have a softening temperature of 70° C. and a run-off starting temperature of 88° C. as measured by a flow tester manufactured by Shimadzu Seisakusho Ltd.

Advantages of the heat roller fixing device of the invention:

With the above arrangement of the invention, since the fixing temperature range for toners can be increased, it is possible to lower a temperature setting. Therefore, it becomes possible to increase the durability and service life of the heating roller, and smooth high-quality images can be produced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A fixing device for fixing a toner image by passing a toner carrier with toner images of plural colors carried on a surface thereof, between a heating roller and a pressure roller which are pressed against each other, wherein said heating roller has a surface layer made of silicone rubber having a thickness ob 0.4 mm at most, and said pressing roller has a surface layer made of an elastic material, wherein each of said rollers has a nip width, L, and a peripheral speed, v, with the ratio L/v being at least 0.07 sec., and the pressure of contact between said rollers per nip area is at least 6 kg/cm$^2$, wherein a wide toner fixing range is obtained.

2. The fixing device of claim 1, wherein said pressing roller has a surface layer made of silicone rubber as said elastic material.

3. The fixing device of claim 1, comprising a means for detecting the temperature of the surface of said heating roller.

4. The fixing device of claim 1, comprising a means for detecting the temperature of the surface of said heating roller and a temperature controller means for controlling the temperature of the surface of said heating roller.

5. The fixing device of claim 1, comprising a means for pressing said rollers against each other and a drive means.

* * * * *